United States Patent [19]

Herbst et al.

[11] Patent Number: 4,958,961

[45] Date of Patent: Sep. 25, 1990

[54] ANCHORING ARRANGEMENT FOR A ROD-SHAPED TENSION MEMBER FORMED OF FIBER REINFORCED COMPOSITE MATERIAL

[75] Inventors: Thomas Herbst, Wessling; Dieter Jungwirth, Bad Heilbrunn, both of Fed. Rep. of Germany

[73] Assignee: Dyckerhoff & Widmann Aktiengesellschaft, Munich, Fed. Rep. of Germany

[21] Appl. No.: 419,151

[22] Filed: Oct. 10, 1989

[30] Foreign Application Priority Data

Oct. 8, 1988 [DE] Fed. Rep. of Germany ..... 3834266

[51] Int. Cl.[5] ..... E02B 1/00; E04C 3/10

[52] U.S. Cl. ..... 405/260; 52/223 R; 52/225; 52/354; 52/733; 52/737; 52/726; 52/787; 403/265; 403/267; 403/268; 405/258; 405/259; 411/82; 411/258; 411/301; 411/302; 411/303; 411/304; 411/428; 411/432

[58] Field of Search ..... 52/223 R, 225, 733, 52/787, 354, 726, 737; 403/267, 268, 265; 405/260; 411/82, 301–304, 908, 258, 428, 432; 264/136; 29/460; 299/33

[56] References Cited

U.S. PATENT DOCUMENTS

| | | | |
|---|---|---|---|
| 2,257,589 | 9/1941 | Brackett | 411/301 |
| 3,061,455 | 10/1962 | Anthony | 411/258 |
| 3,146,142 | 8/1964 | Maly | 411/258 X |
| 3,437,541 | 8/1969 | Cooper | 411/258 X |
| 3,559,275 | 2/1971 | Slater | 29/460 X |
| 3,561,098 | 2/1971 | Voelker | 403/267 X |
| 3,634,577 | 1/1972 | Kull | 411/258 X |
| 3,979,186 | 9/1976 | Mizuma | 52/737 X |
| 4,095,389 | 6/1978 | Outram | 52/726 X |
| 4,556,350 | 12/1985 | Bernhardt | 405/260 X |
| 4,620,401 | 11/1986 | L'Espérance | 411/908 X |
| 4,623,290 | 11/1986 | Kikuzawa | 411/908 X |
| 4,648,224 | 3/1987 | Kitta | 52/223 R |
| 4,752,151 | 1/1988 | Ashida | 403/267 |
| 4,778,637 | 10/1988 | Adams | 264/136 |
| 4,781,505 | 11/1988 | Watanabe | 411/301 |

FOREIGN PATENT DOCUMENTS

| | | | |
|---|---|---|---|
| 3703974 | 9/1957 | Fed. Rep. of Germany . | |
| 1936078 | 1/1971 | Fed. Rep. of Germany . | |
| 783579 | 9/1957 | Sweden | 411/258 |

*Primary Examiner*—Carl D. Friedman
*Assistant Examiner*—Deborah M. Ripley
*Attorney, Agent, or Firm*—Toren, McGeady & Associates

[57] ABSTRACT

A rod-shaped tension member formed of fiber reinforced composite material is utilized as an anchoring rod in foundation and mining construction, or as a reinforcing member in concrete and prestressed concrete construction. At least, in an axially extending region where it is to receive an anchoring member, such as a rod, the tension member has a continuous helical thread formed of alternating ribs and recesses. The anchoring member has a corresponding thread so that it can be screwed onto the tension member thread. An intermediate layer is provided between the threaded regions of the tension member and the anchoring nut, and is formed of a material affording large plastic deformation relative to the tension member when slight stress increases occur at overload conditions. Accordingly, between the threads on the tension member, and the nut, the plastically deformable intermediate layer has a strength less than that of the fiber reinforced composite material whereby it is subject to compression, acting transversely of the rod. As a result, stress peaks in the tension member are avoided by the plastic deformation of the intermediate layer.

9 Claims, 1 Drawing Sheet

ANCHORING ARRANGEMENT FOR A ROD-SHAPED TENSION MEMBER FORMED OF FIBER REINFORCED COMPOSITE MATERIAL

BACKGROUND OF THE INVENTION

The present invention is directed to an anchoring arrangement for a rod-shaped tension member formed of a fiber reinforced composite material. Such a tensioning member can be used as an anchoring member in foundation or mining construction, or as a reinforcing member in concrete or prestressed concrete construction.

Recently, in civil engineering construction, tension members formed of high strength fiber reinforced composite materials have found increasing use in place of steel tension members. Tension members formed of fiber reinforced composite materials, such as polyamides or aramides, reinforced by glass or carbon fibers, have a low specific gravity as compared to a comparable tensile strength steel and, in addition, such tension members have a high resistance to corrosion. Tension members, based on such properties, can be used advantageously as anchoring rods in foundation and mining construction, where they are often exposed to aggressive water action which promotes corrosion in steel tension members.

Tension members or rods formed of fiber reinforced composite materials act under load similar to steel tension members, that is, they have an essentially linear stress-strain characteristic. Contrary to steel tension rods, however, they have no yield point or elastic limit, instead, they fail upon reaching a given tensile strength without any previous plastic deformation. This characteristic and the very low lateral compression strength, as compared to their strength in the elongated direction of the fibers, has prevented the previously known anchoring arrangements from being utilized in construction.

Another problem has been noted in such anchoring arrangements. Due to the length required for force transmission between a tension rod and an anchoring member, such as an anchoring nut, the danger increases that the deformation in the tension member and in the anchoring member are no longer comparable to one another and they may even act counter to one another. As an example, an anchoring nut bearing against an anchor plate is subjected to compressive stress and, as a result, is upset, while at the same time, the tension rod is subjected to tensile stress and is elongated. In the case of sleeve or socket connections of tension rods, the connecting sleeve is also elongated, however, the elongation of the tension member and the sleeve do not coincide because of their different cross-sectional areas or at the least, the elongations are unevenly distributed along the length of the sleeve connection.

When metallic materials are used, such as steel, such a problem is solved mainly by plastic deformation of the material itself which has the property of adapting to load peaks by yielding. When non-metallic materials are used, however, these problems are very evident. It should be noted when tension members are formed of fiber reinforced composite materials, there is an elongation four times greater than experienced in steel at the same tensile stress, however, because of its very low laminar shear strength and high lateral compressive sensitivity, relatively long distances are required for mutual force transmission between the tension rod and the anchoring member.

Attempted uses of fiber reinforced composite material rods, as prestressing members, in prestressed concrete construction has resulted mainly in anchoring by frictional locking achieved by clamping forces or by bonding. Anchoring produced by frictional locking, however, is not only expensive because of the necessity to generate clamping forces for its effectiveness, there are other problems because the dependability of such an anchoring arrangement over long periods of time depends upon the materials, particularly those used for the clamping member and must maintain their properties over extended periods of time. The frictional locking action cannot be guaranteed with any certainty, since creeping due to ageing must be taken into account. If the anchoring is effected by bonding, there is the disadvantage, in order to produce an anchor at the desired point of the tension rod, that more or less extensive measures have to be taken requiring considerable expense and apparatus which must be available at the construction site.

For the use of fiber reinforced composite material rods, comparable to conventional reinforcing rods for concrete, it has been known to provide such a rod with a profiled surface for improving the bond with the concrete. The profiled surface can be provided by helically shaped grooves or ribs, such as disclosed in DE-U 19 36078. A point type of anchoring by anchor members is not mentioned in this connection, it would lead to the problems mentioned above.

Finally, it has been known from DE 37 03 974A1, to construct a rod-shaped tension member from high strength unidirectional fibers enclosed by a jacket in a shear resistant manner. The material of the jacket has an extensibility larger than that of the fiber and is plastically deformable if overstressed. Further, it is possible to provide the jacket with a profiled surface suitable for positive locking engagement with anchoring or connecting members having a correspondingly shaped surface profile, such as in the form of a coarse thread. With this jacket, deformation compensation can take place in an anchoring region between the tension member and an anchoring body with load peaks being carried by the plastic deformation. In every instance, the anchoring force must be transmitted by the adhesive bond between the tension member and the jacket.

SUMMARY OF THE INVENTION

Therefore, the primary object of the present invention is to provide an anchoring arrangement for transmission of the anchoring force by a direct positive and frictional lock between an anchoring member and a tension member or rod formed of a fiber reinforced composite material without developing excessively high tension forces in the tension rod.

In accordance with the present invention, the tension member is provided with a continuous shaped profile forming a thread extending in a helical manner, at least in the region where an anchoring member is to be secured, and threading an anchoring member or nut provided with a thread corresponding to that on the tension member. Further, an intermediate layer is provided between the tension member and the anchoring member, formed of a material characterized by large deformations with a small increase in tension when the tension member is in the overloaded condition.

The intermediate layer can be applied directly onto the inner surface of the anchoring member or it can be introduced into an intermediate space between the tension member and the anchoring member by filling the intermediate space completely.

In accordance with the invention, a rod-shaped tension member formed of a unidirectional fiber reinforced composite material has a shaped surface forming a thread arranged to coact with a similarly shaped surface on an anchoring member affording a positive and frictionally locked engagement between the two. The basic concept of the invention is that a buffer or cushioning layer, forming a plastically deformable zone, is provided between the tension member and the anchoring member or, more specifically, between the surfaces of the two elements arranged in interengagement with one another. The intermediate layer must have a lesser strength than the fiber reinforced compound material when subjected to lateral compression so that significant deformations in the intermediate layer take place with small increases in tension in the tension rod when the rod is under load commencing with a specific compressive stress. Plastic material has the desired properties for the intermediate layer. The intermediate layer can be formed of various plastic materials, such as: polyethylene, a thermoplastic material; or an epoxy resin or the like, a thermosetting plastic. The intermediate layer can also be formed of a subsequently swelling material which exerts a transverse compression on the tension member.

In a preferred embodiment, the shaped surface of the tension member is an unsymmetrical trapezoidal thread, where the thread ribs are wider than the thread grooves.

With such a structure in the anchoring region, an anchoring force is transmitted by a steel nut or anchoring member through the intermediate layer and the synthetic plastics material of the tension member to the fiber, whereby an adequate chain of damping elements is present. The anchoring nut does not have to be formed of steel, it could be fabricated from an appropriately reinforced thermoplastic material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
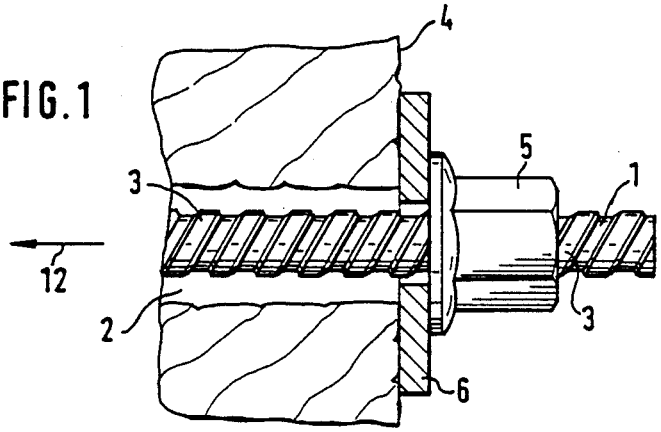
FIG. 1 is a side view, partly in section, of a rock anchor embodying the present invention.

In FIG. 1, a partly sectional view is provided of the anchoring arrangement of a rock anchor with a tension or anchor rod 1 extending into a borehole 2. Anchor rod 1 is formed of a fiber reinforced composite material of appropriate strength. The anchor rod has a shaped outside surface forming a thread 3. An anchoring member is located on the end of the anchor rod outside of the borehole for securing the face of the material in which the borehole is formed. The anchoring member is a nut 5 bearing against an anchor plate 6 which, in turn, bears against the face 4 of the material to be secured. This arrangement is shown only as an example, since the invention can be used in other anchoring arrangement utilizing rods of a fiber reinforced composite material.

Figure 2:
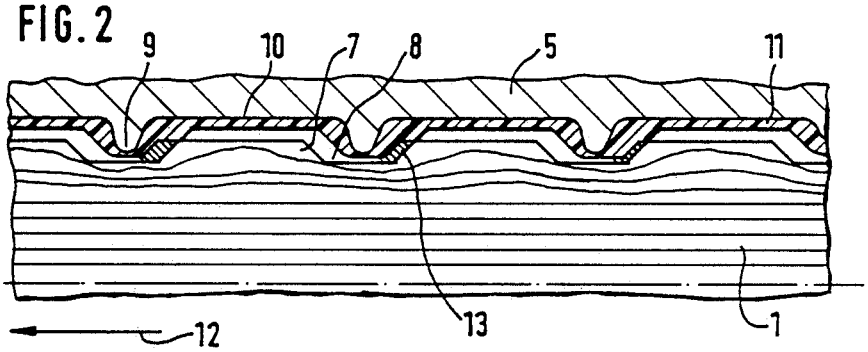
FIG. 2 is an enlarged axially extending section through a region of the anchoring arrangement affording force transmission between a tension rod and an anchor nut.

In FIG. 2, a part of the force transmission region between the anchor rod 1 and the anchor nut 5 is displayed in axial section with the thread 3 made up of alternating ribs 7 and recesses 8 of trapezoidal cross-section on the outside surface of the rod 1. As can be observed, ribs 7 are wider in the axial direction than the recesses 8, to assure proper transmission of shear forces. Thread 3 can be produced by establishing a deformation pressure in the radial direction on the external surface of the rod 1 during a hardening process of the synthetic resin material forming the rod and enveloping the unidirectional fibers for bonding of the resin material and the fibers. Such deformation pressure produces the recesses 8 by an embossing process. As a result, the reinforcing fibers are not cut, however, as can be seen in FIG. 2, the outer fibers are somewhat redirected in the axial direction of the rod 1. Anchor nut 5, threaded onto the anchor rod 1, has an inner surface configuration of ribs 9 and recesses 10 for affording threaded engagement between the rod and the nut. The inner surface of the anchoring nut 5 with the ribs 9 and recesses 10 has an intermediate layer 11 of a plastics material deposited thereon so that the layer has the same configuration as the ribs and depressions and forms part of the thread in the nut corresponding to the ribs and recesses on the anchor rod, so that the anchor nut 5 with the intermediate layer 11 can be securely threaded onto the anchor rod 1 for effecting a locking engagement.

If a tensile force is applied to the anchor rod 1 in the direction of the arrow 12, the anchor nut 5 is pulled against the anchor plate 6, and the material of the intermediate layer 11 having a greater ductility than the material of the anchor rod can avoid locally occurring stress peaks through plastic deformation. In FIG. 2, the deformation is indicated by shaded areas 13. Shaded areas 13 are greater in the region of the anchor nut facing the abutment because of the extension of the anchor rod and they diminish toward the region facing away from the abutment.

Figure 3:
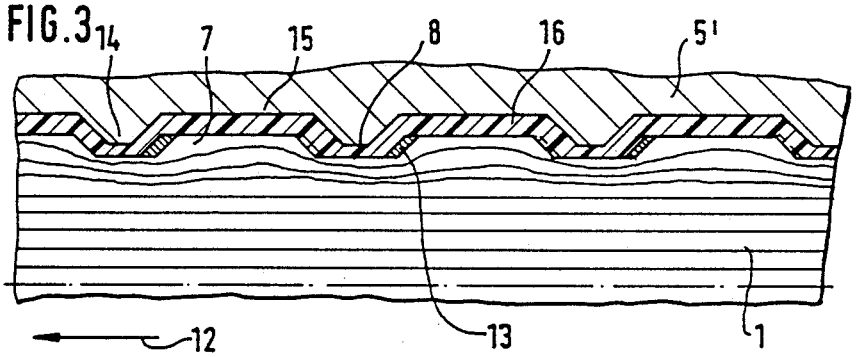
FIG. 3 is a view similar to FIG. 2, showing another embodiment of the anchoring arrangement.

Another abutment of the anchoring arrangement is illustrated in FIG. 3, also displaying a partial axially extending section where the anchor rod 1 has alternating ribs and recesses forming a helical thread. Anchor nut 5' has a corresponding thread formed of alternating ribs 14 and recesses 15. In this anchoring arrangement, the threads on the anchor rod 1 and the anchor nut 5' are sized to provide an open space between them. A material 16 is introduced, that is, injected into the intermediate space between the anchor rod 1 and the anchor nut 5' which space affords the clearance required for threading the nut onto the rod. The material 16 completely fills the intermediate space and forms an intermediate layer 16. If a tensile force is applied to the anchor rod 1 in the direction of the arrow 12 with abutment of the anchor nut 5' as in FIG. 1, the intermediate layer 16 will undergo plastic deformation increasing in the direction of force as indicated by the shaded areas 13.

Materials having a pronounced subsequent swelling characteristic are considered to be particularly advantageous as materials for the intermediate layers 11, 16 so that the layers exert a compressing action on the anchor rod 1. Such action increases the inter-laminar shear strength whereby, under certain circumstances, the anchoring length can be reduced.

While specific embodiments of the invention have been shown and described in detail to illustrate the application of the inventive principles, it will be understood that the invention may be embodied otherwise without departing from such principles.

We claim:

1. Anchoring arrangement for anchoring a rod-shaped tension member formed of a fiber reinforced composite material for use as an anchor element in foundation and mining construction or as a reinforcing member for concrete and prestressed construction, said tension member has an outside surface with a helical thread formed thereon, an anchoring member having an inside surface with a helical thread formed therein arranged to interfit with the thread on said tension member and disposed in radially spaced relation thereto, and an intermediate layer located between and in engagement with the thread on said tension member and the thread on said anchoring member, and said intermediate layer is formed of a material affording large deformations relative to said tension member and anchoring member at slight increases in stress when overloads act on the tension member.

2. Anchoring arrangement, as set forth in claim 1, wherein the intermediate layer is deposited on the inside surface of said anchoring member.

3. Anchoring arrangement, as set forth in claim 1, wherein the material forming the intermediate layer is placed between the anchoring member and the tension member after the anchoring member is screwed onto the tension member so that the material forming the intermediate layer completely fills an intermediate space formed between the threads of the tension member and anchoring member.

4. Anchoring arrangement, as set forth in claims 1, 2 or 3, wherein the intermediate layer is formed of a plastics material.

5. Anchoring arrangement, as set forth in claim 4, wherein said plastics material is a thermoplastics material.

6. Anchoring arrangement, as set forth in claim 4, wherein the plastics material forming the intermediate layer is a thermosetting plastics material.

7. Anchoring arrangement, as set forth in claim 4, wherein said plastics material forming said intermediate layer has a subsequent swelling property for exerting a compression on said tension member transverse to the direction of the tension member.

8. Anchoring arrangement, as set forth in claim 1, wherein said thread on said tension member comprises alternating ribs and recesses, said thread on said tension member is an unsymmetrical trapezoidal thread with the ribs being wider than the recesses.

9. Anchoring arrangement, as set forth in claim 1, wherein said threads on said tension member and anchor member comprise alternating ribs and recesses, said ribs on said tension member extend into said recesses on said anchor member and said intermediate layer fills the space between said thread on said tension member and said thread on said anchor member.

* * * * *